United States Patent [19]

Baum

[11] 4,436,189

[45] Mar. 13, 1984

[54] MULTI-PURPOSE TRAVELING BAG

[76] Inventor: Frank Baum, 1030 E. 30th St., Hialeah, Fla. 33013

[21] Appl. No.: 366,499

[22] Filed: Apr. 8, 1982

[51] Int. Cl.[3] ..... A45C 5/06; A45C 13/00

[52] U.S. Cl. ..... 190/108; 190/119

[58] Field of Search ..... 190/41 B, 41 Z, 43, 190/52

[56] References Cited

U.S. PATENT DOCUMENTS

| | | | |
|---|---|---|---|
| Re. 25,826 | 8/1965 | Ward | 190/43 X |
| 2,003,100 | 5/1935 | Arpin | 190/41 B X |
| 2,154,630 | 4/1939 | Marbury et al. | 190/43 |
| 2,370,492 | 2/1945 | Russell | 190/43 |
| 2,637,424 | 5/1953 | Duskin | 190/43 |
| 3,929,224 | 12/1975 | Smith, Jr. | 190/41 B X |
| 3,958,675 | 5/1976 | Rosenblum | 190/41 B X |
| 4,081,061 | 3/1978 | Tucker | 190/52 |
| 4,206,835 | 6/1980 | Shapiro | 190/52 X |

FOREIGN PATENT DOCUMENTS

| | | | |
|---|---|---|---|
| 946333 | 4/1974 | Canada | 190/41 B |
| 1076765 | 10/1954 | France | 190/41 Z |

*Primary Examiner*—William Price

*Assistant Examiner*—Sue A. Weaver

*Attorney, Agent, or Firm*—Ernest H. Schmidt

[57] ABSTRACT

A lightweight traveling bag having a garment bag portion, side bag compartment portions and a briefcase compartment portion, all fabricated from flexible fabric and all of which compartments are releaseably attached to the outsides of the garment bag portion for selective use in various combinations, wherein the garment bag portion with the side bag compartments and briefcase compartment attached can be folded lengthwise to assume the size and appearance of a composite piece of hand luggage for convenient carrying. The garment bag assembly can be released for unfolding to its full length for hanging in the garment bag compartment while traveling in a commercial aircraft or for hanging in an ordinary closet, a hook being provided at the upper end of the garment bag portion for this purpose. Alternatively, the side bag compartment portions can be separately attached to each of the outsides of the briefcase compartment portion to provide a hand luggage assembly that can be used independently of the garment bag portion, and which is of such overall size as permits stowing under the seat of a commercial aircraft.

1 Claim, 20 Drawing Figures

2
45
41
10
42
19
43
12
44
32
36
13
11
33
2
31
12
32

19
21
41
24
12
15
37
38
39
40
11
13
18
42
12

25
21
42
17
18
22
41
23
20
13
12
12
15
14
11

39
40
12
36
13
31
12
33

41
11
16
17
18
42

41
21
44
26
28
14
29
27
11
43
42
18

19
17
42
18

21
15
35
42
18

12
31
33
32

32

32
34
30
12

32

32

34

39
40
36

13
34
40
34

40
39
36

38
37
39
34
13

MULTI-PURPOSE TRAVELING BAG

BACKGROUND OF THE INVENTION

This invention relates to luggage, and is directed particularly to a multi-purpose traveling bag construction particularly suited to use by those who travel extensively by commercial aircraft, such as business executives, salesmen, and the like.

The use of lightweight foldable garment bags of one kind or another having not only a main part for the hanging of clothes such as suits, dresses, shirts and the like, but also having affixed thereto, separate compartments for carrying other articles of clothing is known. Such garment bag luggage heretofore devised, however, is deficient in various respects, principally in the lack of versatility of usage of those who travel extensively for business purposes. For example, in the usual instance of a businessman traveling by air from place-to-place during a trip of a week or more, he would carry a garment bag, a piece of hand luggage of sufficient size for carrying articles of clothing not accommodated in the garment bag, and a briefcase for separately carrying business papers. These different articles of luggage are difficult to handle and carry from place-to-place, and often need to be separately stored while aboard an aircraft.

It is, accordingly, the principal object of this invention to provide a multi-purpose traveling bag comprising a garment bag portion, to the outsides of which side bag compartment portions and a briefcase compartment portion can be removably attached as may be needed for a particular trip, and which, with such auxiliary compartment portions thus attached, can be folded together to provide a unitary traveling bag that can be readily carried from place-to-place, and wherein the various attached compartments of which can be selectively detached for independent use.

A more particular object of the invention is to provide a multi-purpose traveling bag of the character described wherein the side bag compartment portions and the briefcase compartment portion can be interconnected independently of the garment bag portion to provide a separately usable piece of hand luggage of such reduced overall size as permits stowage under the seat of a commercial aircraft.

Yet another object is to provide a multi-purpose traveling bag construction of the above nature wherein the briefcase compartment portion can readily be detached either from the garment bag portion, or from the side bag compartment portions when used as an auxiliary piece of hand luggage, for independent use at business meetings, for example.

Other objects, features and advantages of the invention will be apparent from the following description when read with reference to the accompanying drawings.

BRIEF DESCRIPTION OF THE DRAWINGS

In the drawings, wherein like reference numerals denote corresponding parts throughout the several views.

Figures 1, 2, 3, 20:
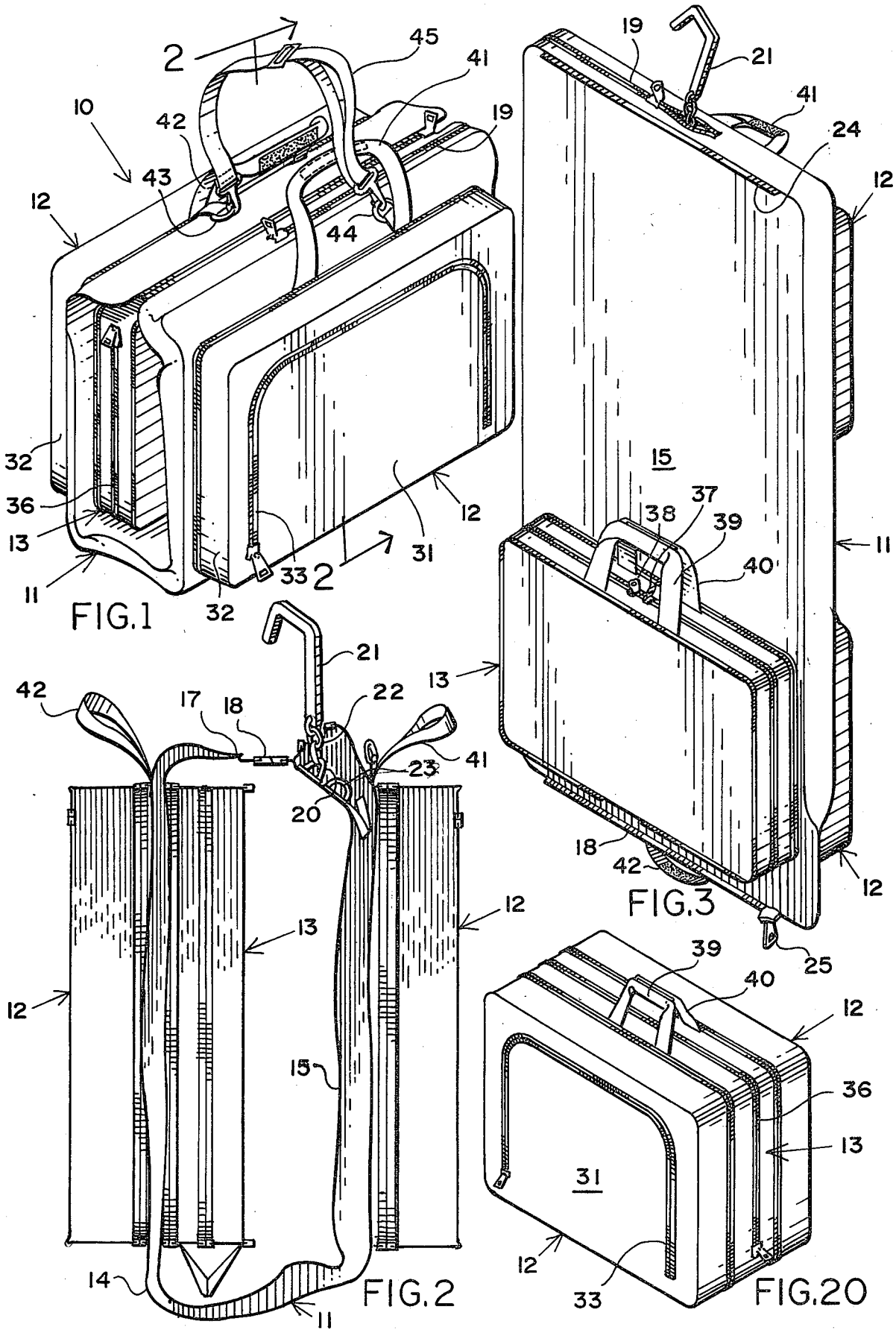
FIG. 1 is an oblique view as seen from above of a multi-purpose traveling bag embodying the invention shown in folded-together condition for use in carrying as a piece of hand luggage.
FIG. 2 is a vertical cross-sectional view taken along the plane indicated at 2—2 of FIG. 1 in the direction of the arrows, illustrating how the main zipper across the top, upon being opened, permits unfolding of the assemblage into a vertically-extended garment bag with a hook at the top for hanging.
FIG. 3 is an oblique view illustrating the multi-purpose traveling bag opened and vertically extended, with the hook at the top for use in hanging.
FIG. 20 is an oblique view as seen from above of a piece of hand luggage assembled from the side bag compartment portions and the briefcase compartment, utilized separately of the garment bag portion.

Referring now in detail to the drawings, reference numeral 10 illustrates a preferred form of a multi-purpose traveling bag, shown in fully-assembled and folded condition for carrying in FIG. 1, unzipped in FIG. 2, and extended for hanging in FIG. 3. The various bag or container portions open and close with zippers, and are all fabricated of a heavy, flexible, woven fabric.

The multi-purpose traveling bag 10 comprises a garment bag portion 11, a pair of identical side bag compartment portions 12, 12, and a briefcase compartment portion 13, said side bag and briefcase compartment portions being selectively attachable and removable with respect to the garment bag portion 11 by the use of zippers.

Figures 4, 5, 6, 7, 8, 9, 10, 11, 12, 13, 14, 15, 16, 17, 18, 19:
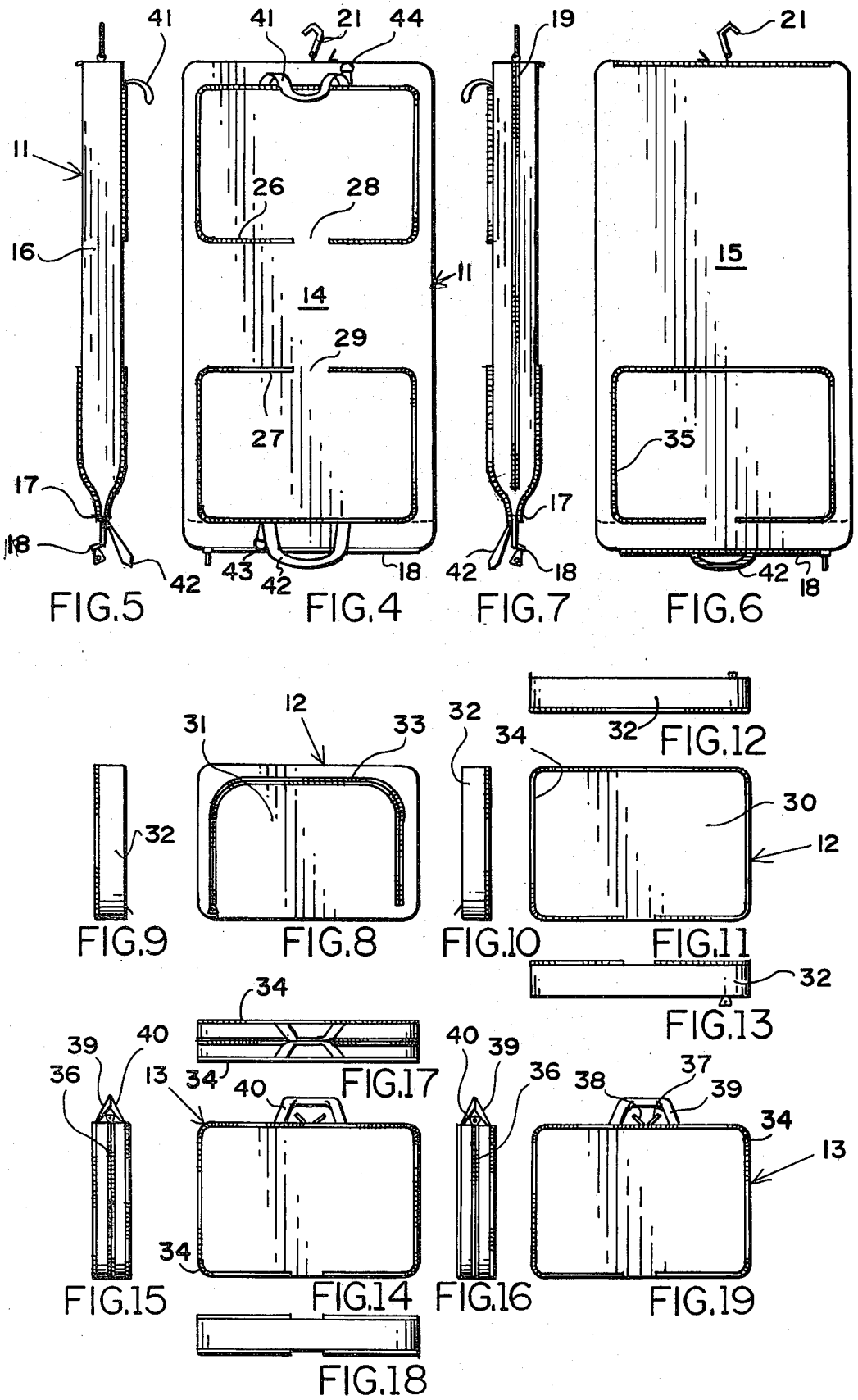
FIG. 4 is an outside elevational view of the garment bag portion of the assembly, shown separately.
FIG. 5 is a left side elevational view of the garment bag portion illustrated in FIG. 4.
FIG. 6 is an inside elevational view of the garment bag portion of the assembly, shown separately.
FIG. 7 is a left side elevational view of the garment bag portion illustrated in FIG. 6.
FIG. 8 is an outside elevational view of one of the removable side bag compartment portions shown separately.
FIG. 9 is a left side elevational view thereof.
FIG. 10 is a right side elevational view thereof.
FIG. 11 is an inside elevational view of one of the removable side bag compartment portions.
FIG. 12 is a top view thereof.
FIG. 13 is a bottom view thereof.
FIG. 14 is an outside elevational view of the removable briefcase compartment portion, shown separately.
FIG. 15 is a left side elevational view thereof.
FIG. 16 is a right side elevational view thereof.
FIG. 17 is a top view thereof.
FIG. 18 is a bottom view thereof.
FIG. 19 illustrates, in elevational, the opposite side of the briefcase compartment portion illustrated in FIG. 14.

As best illustrated in FIGS. 4 through 7, the garment bag portion 11 comprises substantially rectangular outer and inner fabric panels 14, 15, respectively, sewn in spaced relation at each side of a comparatively narrow side panel 16 defining, together with said outer and inner panels, an interior compartment for hanging clothes. As best illustrated in FIGS. 3, 5 and 7, the lower ends of the outer and inner panels 14, 15 are extended somewhat, and sewn together as indicated at 17, whereat they also have sewn therealong a main zipper strip 18.

As best illustrated in FIGS. 3 and 7, the side panel 16 of the garment bag portion 11 is provided with a central zipper 19 extending across the top and down the left side (as illustrated in FIG. 3) to permit opening for the insertion of garments for hanging. As best illustrated in FIG. 2, the interior of the inner panel 15 of the garment bag, at a central position near the top, is provided with a metal loop 20 to which a hanging hook 21 is attached by a short chain 22. Metal hook eyes 23 are also provided just below the hanging hook loop 20 for use in suspending garments within the garment bag from their clothes hangers.

As best illustrated in FIGS. 2 and 3, the upper end of the inner fabric panel 15 of the garment bag portion 11 has sewn or otherwise attached thereto a main zipper strip 24 cooperative with the main zipper strip 18 along the lower end of said garment bag portion for releaseably securing the lower end thereof to the top end thereof with use of zipper slide 25 (see FIG. 2).

The outer fabric panel 14 of the garment bag portion 11 comprising the multi-purpose traveling bag has sewn or otherwise attached thereagainst a pair of opposed, upper and lower zipper strips 26, 27, respectively, (see FIG. 4) said zipper strips each following a rectangular course which is incomplete for a short distance at the middle of their facing runs, as indicated at 28 and 29, respectively. These zipper strips or runs serve to removably attach side bag compartment portions 12, 12, in the manner and for the purpose hereinafter more particularly described.

As best illustrated in FIGS. 9 through 13, each side bag compartment portion 12 is rectangular in shape, and comprises an inside panel 30, an outside panel 31, and a peripheral side wall panel 32. The outside panel 31 of side bag compartment portion 12 is provided with a U-shaped zipper strip 33 in closely spaced relation to the sides and top thereof to permit opening and closing of said outside panel for the packing and removal of articles of clothing, or the like.

As illustrated in FIG. 11, the inside panel 30 of each side bag compartment portion 12 is provided with a continuous peripheral zipper strip 34, the ends of which extend somewhat short of each other centrally at the bottom of said inside panel. The zipper strip 34 is complemental in size and configuration with the zipper strips 26, 27 to enable individual zippering in place of said side bag compartment portions against the outer panel of the garment bag portion 11. As illustrated in FIGS. 1 and 2, when the traveling bag is folded together for carrying as a piece of hand luggage, side bag compartment portions 12, 12 are attached at the outsides with their U-shaped zipper strips 33 open at the bottom so that their side wall flaps conveniently open from the top of the folded traveling bag assembly.

As illustrated in FIGS. 14 through 19, the briefcase compartment portion 13 is of the same size as the side bag compartment portions 12, 12, and is similarly provided, at each side, with a peripheral zipper strip 34, the ends of each of which extend somewhat short of each other at the bottom. It will thus be apparent that either one of these peripheral zipper strips can be used to attach the briefcase compartment portion 13 with respect to either of the garment bag portion complemental zipper strips 26, 27 if desired for any reason. As illustrated in FIGS. 1, 2, 3 and 6, however, the inner fabric panel 15 of the garment bag portion 11 is provided at the lower end (see FIG. 6) with a zipper strip 35, similar to zipper strip 27, at the opposite side of said garment bag portion, but with the open gap at the bottom, to which the briefcase compartment will normally be removably attached when the multi-purpose traveling bag is fully assembled as illustrated in FIGS. 1, 2 and 3.

As best illustrated in FIGS. 1 and 3, the side wall of the briefcase compartment portion 13 is provided with a central zipper 36 extending across the top down each side (see FIGS. 15, 16 and 17), equipped with two zipper slides 37, 38 permitting opening of the briefcase compartment portion to each side from the top (see FIG. 3). As further illustrated in FIG. 3, the briefcase compartment portion 13 is provided at the top with a central carrying handle 40 comprising fabric strip loops 39, 40, the ends of which are attached to and extend upwardly along each side of said briefcase compartment portion and which are faced with opposed "VELCRO" fastening strips to releaseably secure the upper ends of the fabric strip loops 39, 40 together.

As illustrated in FIGS. 1 and 4, the outer side 14 of the garment bag portion 11 is provided with fabric strap loops 41, 42 extending outwardly near the top and the bottom, respectively, which, when the traveling bag is folded and zippered together as illustrated in FIG. 1, can be brought together at the top of the traveling bag assembly for carrying by hand. As further illustrated in FIGS. 1 and 4, the upper and lower end portions of garment bag portion outer panel 14 are also provided with hook eyes 43, 44, attached at opposite sides of respective handle strap loops 41, 42, to which an adjustable shoulder strap 45 can be hooked, as illustrated in FIG. 1, for alternative use in carrying the bag suspended from a shoulder.

An important feature of the invention resides in the fact that the briefcase compartment portion can be used either independently as illustrated in FIGS. 14 through 19, or as illustrated in FIG. 20, in combination with side bag compartment portions 12, 12 attached at each side to provide an additional piece of hand luggage of such reduced size as will fit under the seat of a commercial aircraft while traveling from place-to-place. The multi-purpose traveling bag 10 can thus be used first in fully assembled condition as illustrated in FIG. 1 to accommodate the needs of an extended trip away from home, whereupon, from that destination, side trips of shorter duration can be accommodated by use of the auxiliary piece of hand luggage assembled from the briefcase compartment portion 13 and side bag compartment portions 12, 12, assembled as illustrated in FIG. 20. With either usage, of course, the briefcase compartment portion 13 can be separated for separate use for local business meetings.

While I have illustrated and described herein only one form in which my invention can be conveniently embodied in practice, it is to be understood that this embodiment is presented by way of example only, and not in a limiting sense. The invention, in brief, comprises all the embodiments and modifications coming within the scope and spirit of the following claims.

What I claim as new and desire to secure by Letters Patent is:

1. A multi-purpose traveling bag comprising, in combination a substantially rectangular, elongated garment bag portion, said garment bag portion comprising inner and outer flexible panels secured in spaced relation by a comparatively narrow flexible side panel, said inner and outer panels and said side panel defining, together, an interior compartment for hanging clothes, means for opening said interior compartment for the insertion and removal of clothes, a pair of side bag compartment portions of substantially rectangular shape and each having a flexible inside panel, a flexible outside panel and a flexible, peripheral side wall panel defining with said inside and outside panels a second interior compartment, the outside panel of each of said side bag compartment portions being fitted with a zipper strip for opening and closing said side bag compartment portion, zipper means for peripherally attaching said inside panel of said side bag compartment portions, one each, to upper and lower longitudinal end portions, respectively, of said outer panel of said garment bag portion, a briefcase compartment portion of the same rectangular shape as that of said side bag compartment portions, said briefcase compartment portion having a pair of opposed outside panels secured in a spaced relation by a peripheral, flexible, briefcase side wall panel and defining therewith a third interior compartment, zipper means in said peripheral briefcase side wall panel for opening and closing said briefcase interior compartment, zipper means for removably attaching said briefcase compartment portion, face-to-face against said inside panel of said garment bag portion at the lower longitudinal end portion thereof, and zipper means for detachably securing a lower edge portion of said inner panel of said elongated garment bag portion with the upper edge portion thereof upon said elongated garment bag portion being folded double to the inside from bottom to top, hand carrying means at the upper end of said garment bag portion when so folded and secured, said means for opening said interior compartment of said garment bag portion comprising a zipper extending along the upper end of said garment bag portion side panel, and a hook flexibly linked with respect to the inside of said interior compartment of said garment bag portion and extensible through said zipper when partially opened to permit hanging of said garment bag portion from a clothes pole or the like, said zipper means for peripherally attaching said inside panel of said side bag compartment portions being selectively cooperative with said zipper means for removably attaching said briefcase compartment portion against said inside panel of said garment bag portion, selectively, to detachably secure said side bag compartment portions, one each, to the sides of said briefcase compartment portion, said zipper strip for opening and closing each of said side bag compartment portions following a U-shaped course closely spaced to the peripheral sides and top of said side bag compartment portions to permit the opening and closing of said side bag compartment outside panels, and hand grip means extending outwardly of the upper end of said briefcase compartment portion.

* * * * *